United States Patent [19]

Germanton

[11] 4,019,355

[45] Apr. 26, 1977

[54] PUSHBUTTON COMBINATION LOCK

[76] Inventor: Charles E. Germanton, 38 Mountain Ave., Summit, N.J. 07901

[22] Filed: Dec. 18, 1975

[21] Appl. No.: 642,007

[52] U.S. Cl. ..... 70/278; 70/133; 70/220; 70/276; 70/279; 361/172

[51] Int. Cl.[2] ..... E05B 49/02

[58] Field of Search ..... 70/276, 277, 278, 279, 70/220, 219, 126, 130, 133, 315, 445; 317/134

[56] References Cited

UNITED STATES PATENTS

| | | | |
|---|---|---|---|
| 2,544,330 | 3/1951 | Koenig | 317/134 X |
| 3,475,932 | 11/1969 | Germanton | 70/220 X |
| 3,656,327 | 4/1972 | Ford et al. | 70/278 X |
| 3,704,607 | 12/1972 | Germanton | 70/220 |
| 3,777,519 | 12/1973 | Germanton | 70/220 |

*Primary Examiner*—Roy D. Frazier
*Assistant Examiner*—Rodney H. Bonck
*Attorney, Agent, or Firm*—John P. Sinnott

[57] ABSTRACT

This invention relates to electrical combination locks that compare a sequence of input signals with a stored sequence to permit the lock to be opened. The mechanical features of the lock are characterized by an arm and control member within the lock structure that inhibit bolt motion in the absence of the proper combination. The electrical circuit enables the combination to be changed readily and uses very little power.

14 Claims, 7 Drawing Figures

PUSHBUTTON COMBINATION LOCK

BACKGROUND OF THE INVENTION

1. Field of the Invention

This invention relates to locks and, more particularly, to a combination lock that is controlled through electrical logic circuits, and the like.

2. DESCRIPTION of the PRIOR ART

Pushbutton combination locks have failed to achieve a wide degree of public acceptance because of a number of disadvantages. Among these disadvantages, it appears that inadequate lock security may provide the main reason for this failure. In this respect, some pushbutton locks partially reveal the combination because of the indication of wear that shows after some use of only a few of the buttons in the array that the lock presents. The "feel" that a number of these locks give to the touch of someone engaged in tampering with the combination also is a clear disadvantage, as well as the very limited number of combination possibilities that are available to locks of this nature.

Further in this respect, pushbutton combination locks heretofore have been expensive to manufacture and unreliable in operation because of the large number of small, complicated and failureprone parts that these locks require. In addition to these foregoing problems, pushbutton locks often involve complicated procedures for changing the combination, in some cases requiring an inventory of parts which must be substituted in an existing lock through painstaking assembly and disassembly. Clearly, there is a need for a relatively secure combination lock that satisfies these needs.

SUMMARY OF THE INVENTION

These and other problems are solved, to a large extent, through the practice of the invention. For example, an illustrative embodiment of the invention is characterized by an outside knob that is connected through a collar to a disk within the lock housing. The disk not only rotates with the knob, but also accommodates a control member which engages and disengages an arm that is independently rotatable on the spindle shaft in order to open the lock. This selective engagement and disengagement between the control member and the arm occurs in response to rotation of the knob while applying an appropriate sequence of manipulations to a set of pushbuttons, or tactile switches on the knob. Positioning the pushbuttons on the knob provides a further advantage in that the electrical connections for the pushbuttons may be routed to the lock circuit through the knob collar. This feature of the invention results in a single aperture lock, which is considered to be more secure and tamperproof than multiple aperture lock construction.

When properly engaged, the control member rotates the arm in a direction that draws back the bolt thereby opening the lock. If, however, the proper combination has not been applied to the pushbuttons, the control member cannot engage the arm and prevents the arm from advancing to a position that will enable the bolt to be drawn back.

More specifically, in a typical embodiment of the invention, three pushbuttons are disposed about the center of the outside knob on the lock. The pushbuttons are assigned, respectively, values of 1, 2, and 4. All combinations of a set of pushbuttons including no pushbutton depressed will produce a digit value from 0 to 7, which is the arithmetic sum of the values that are assigned to the activated pushbuttons. Consequently, the number of possible combinations available to a particular lock is computed through the formula $2^{pd}$, where $p$ is the number of pushbuttons on the knob (i.e. three in this illustrative example), and d is the number of digits in the entire combination. Thus, a sequence of five digits, made available through a four-pushbutton lock would make $2^4{}_x{}^5$, or 1,048,576 possible combinations available for the lock. This method of generating a multiple digit combination through selective manipulation of only a few pushbuttons eliminates the tell-tale difference in wear that rendered many prior art locks so vulnerable to tampering.

As the last digit in the combination is properly applied to the lock through appropriate pushbutton manipulation, the control member associated with the disk is suitably magnetized so as to avoid mutual engagement and to allow the motion of the disk to be arrested by impingement against the extended bolt. Knob rotation is manually reversed to permit the control member to engage the arm, sweep the arm along, and retract the bolt into the lock housing.

To relock the door from the outside, the arm, having been swept through the circular arc to retract the bolt, completes a three-part magnetic circuit to shift the control member relative to the arm once more. On turning the outside knob once more in the opposite direction, the arm re-engages the control member and is swept back to thereby drive the bolt out of the lock and into a mating recess in the adjacent door jamb, vault frame, or the like.

The electronic system that activates and deactivates the control member in response to the application of the proper combination to the pushbuttons incorporates a number of additional new features. Among these many novel functions provided by the system logic are the elimination, for instance, of power supply drain during quiescence between successive intervals of lock operation and alarm timing that detects attempts at lock tampering.

Typically, in moving the outside knob from its normal position, a switch is operated to energize the system, initiate the alarm timing, and activate the first of the combination digit memories while inhibiting the other combination digit memory circuits. If the specific set of operated and unoperated pushbuttons matches the value of the first digit in the combination, the circuit is prepared to receive pushbutton inputs that correspond to the next digit in the combination, and so on, until the complete combination has been applied to the lock. With the processing of the last pushbutton sequence, the circuit selectively magnetizes the control member, to permit a relative shift between the arm and the control member. This relative shift, of course, establishes the mutual disengagement and subsequent engagement that is required between the control member and the arm that is needed to retract the bolt in accordance with some of the principle features of the invention.

Should an incorrect sequence of pushbutton activations be applied to the lock, however, the circuit is deactivated and the control member is not shifted in an appropriate manner to allow the rotatable arm to retract the bolt.

As the bolt is being retracted, a further switch is activated within the lock to shift the control member relative to the arm once more in a manner that will enable the bolt to be subsequently driven out of the lock housing when the outside knob is rotated in the opposite direction.

If excessive time is consumed in opening the lock, a timing circuit activates an alarm to alert police, deter burglars, and the like. This timing circuit, moreover, is of a cumulative sort in which the interval that the timing circuit requires to return to normal is substantially longer than the interval required to trigger the alarm. Consequently, attempts to temporarily restore the lock to the usual quiescent condition before the alarm is tripped prior to a further attempt to tamper with the lock in order to deactivate the timer are hampered by the cumulative effect of the timer alarm.

The lock combination can be changed through a lever-like cover that is formed in the lock housing. The cover is lifted to expose a small switch field on the rotatable disk. Manipulation of the desired switches in the field sets the new combination for the lock. The battery, or power supply, for the lock also can be replaced through the up-lifted cover, when necessary.

The various features of novelty which characterize the invention are pointed out with particularity in the claims annexed to and forming a part of this specification. For a better understanding of the invention, its operating advantages and specific objects attained by its use, reference should be had to the accompanying drawing and descriptive matter in which there is illustrated and described a preferred embodiment of the invention.

DETAILED DESCRIPTION OF THE PREFERRED EMBODIMENTS

To simplify description and ease of understanding, the detailed embodiments of the invention are presented in two parts, the mechanical structure of the lock and the electronic logic that controls the operation of the mechanical structure.

Mechanical Structure

Figure 1:
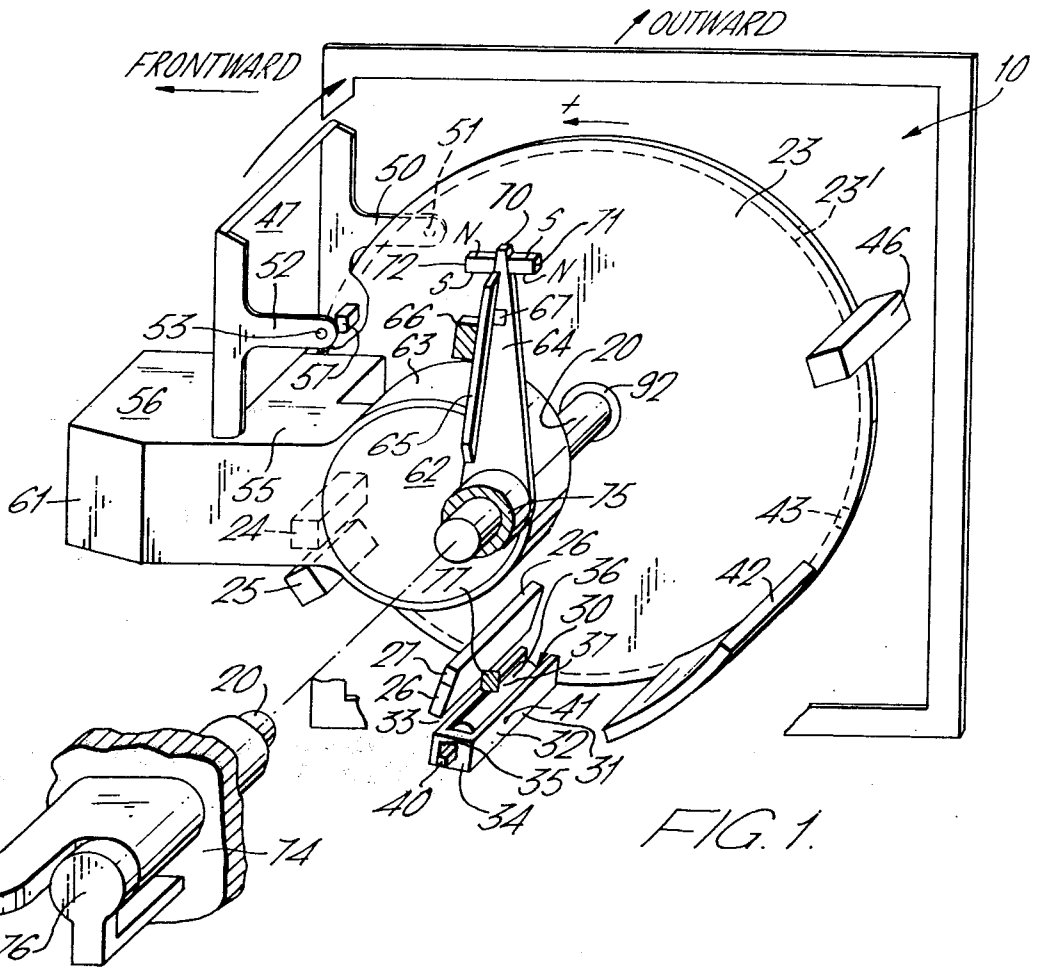
FIG. 1 is an isometric view in full section of a typical mechanical structure for a lock in accordance with the invention, with the inner handle displaced for the purpose of clarity.
Figure 2:
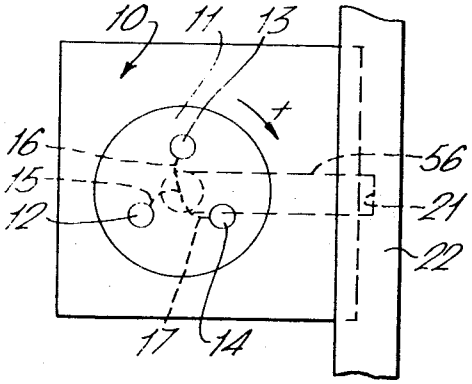
FIG. 2 is a front elevation of the lock shown in FIG. 1 to illustrate a typical "outside" knob and pushbutton arrangement.

As shown in FIG. 2, a typical lock in accordance with a number of features of the invention has a housing 10 that is received within a residential door, bank vault, or the like. A handle, or knob 11 is journaled in the housing 10 for a limited arc of positive and negative rotation. In order to avoid the confusion that arises when the term "clockwise" is applied where the direction of viewing may be either inward or outward, the term "positive" rotation is assigned to clockwise rotation as viewed from the outside. The surface of the knob 11 is provided with three pushbuttons or tactile switches 12, 13, 14. Numerical values of 1, 2, and 4 are assigned to the pushbuttons 12, 13, 14, respectively, in order to enable the individual digits that comprise a multiple-digit combination to be synthesized and addressed to the lock's logic circuits (not shown in FIG. 1) in the form of electrical signals transmitted through conductors 15, 16, 17 that are received in a passageway formed in the knob collar.

For example, assume that the proper combination for the lock is the four-digit number 0715. The first digit in the combination 0 is addressed to the lock's logic by depressing none of the three pushbuttons 12, 13, 14. In a similar manner, the next digit in the combination, 7, is synthesized by depressing all three of the pushbuttons 12, 13, 14, because the sum of the values assigned to these three pushbuttons (1, 2, and 4) is equal to 7. The third digit, 1, is addressed by depressing only the pushbutton 12 because the value assigned to the pushbutton 12 is equal to the numerical value of the third digit in the combination sequence. The electrical signal that relates to the last digit in the combination, 5, is synthesized by manipulating the pushbuttons 12, 14 because the sum of the assigned values for these two pushbuttons (1 and 4) is the number 5.

Write-in of a digit consists of setting and holding the pushbutton combination for the digit and then turning the knob through a small arc at the positive limit of knob travel, the direction alternating after each digit setting. After writing in the last digit the knob is rotated to the positive limit and finally turned in the negative direction to draw bolt 56 out of mating recess 21 in a vault frame, jamb 22, or other structure in order to permit the door to be opened. A typical mechanism for accomplishing this result is shown in FIG. 1. As illustrated, the housing 10 supports the knob collar 92 for limited rotation in positive and negative directions. A disk 23 is rotatable by the knob about the fixed spindle 20. The disk 23 has a peripheral flange 23' that protrudes outwardly of the plane of the FIG. 1 drawing and in a direction that is toward the front of the door.

Mounted near the periphery of the disk 23 for movement with the disk is a switch housing 24 that contains a switch (not shown), for energizing the lock's electrical system, the precise nature and function of which will be described subsequently in more complete detail. A further switch 25 is spaced from the switch 24 along the disk periphery and is secured to and rotates with the disk 23. A magnetically activatable reed switch 26 also is spaced from the switches 24, 25 and is located inward of the disk periphery. The switch 26, moreover, has a pole piece 27 for transmitting magnetic flux to the contact reeds in the switch 26 to selectively activate the switch 26 for purposes to be described subsequently.

The disk 23 also supports a control member 30. The illustrative control member 30 that is shown in FIG. 1 is a channel-shaped frame 31 of which flanges 32, 33 are visible. The base of the channel frame is secured in a radial direction to the same surface of the disk 23 as the adjacent switches 25, 26, 24. The inner end of the frame 30 is a nonmagnetic yoke 34 that has a radially disposed slot 35.

A movable assembly 36 that consists of an electromagnet coil 37 has a remanently magnetizable engaging member 40 that is centrally disposed within the coil 37 with an end of the member 40 protruding through the radially disposed slot 35. The relative widths of the slot 35 and the member 40 is such that the member can shift inwardly and outwardly in a radial direction as the movable assembly pivots about axis 41 which is so located as to be tangential to the circular travel path of the center of gravity of the movable assembly 36.

Proceeding along the periphery of the disk 23 a switch field 42 is attached to the same side of the disk 23 as the control member 30. The switch field 42, moreover, is generally concentric with the axis of the disk 23 and is arranged to expose the switches (not shown in FIG. 1) that comprise the field on the side of the field that is outward from the center of the disk 23. The electrical circuit for the switch field 42 is shown more clearly in the FIG. 3 wiring diagram and will be described in more complete detail in connection with the description of that figure. Suffice to state at this point that the single-pole double-throw switches which typically comprise the field 42 are mechanical devices that can be selectively activated or deactivated through a simple mechanical manipulation. Illustratively, a miniaturized switch field built through printed wiring technique is suitable for this purpose. Because the information stored in this memory is not lost if the energy supply is accidentally interrupted, the mechanical switch memory is particularly well suited for application in a vault or safe.

A port 43, in the outwardly projecting peripheral flange 23' of disk 23, permits access to the switch field 42 as described hereinafter.

Member 46 projects inwardly from the outer wall 10 of the lock housing and is located adjacent to the periphery of the disk 23 at an angular spacing from tip 70 which exceeds the angular spacing between control member 40 and switch 25 by a palpable amount in the order of about ten degrees. The switch 25 can be, for example, a conventional reed switch that is activated through magnetic fields associated with the projection 46.

An access hatch 47 is arranged in the lock to form a part of the side of the lock that is opposite to the striker plate (not shown in FIG. 1) or to the door jamb 22 (FIG. 2). As shown in FIG. 1, the hatch 47 is secured to the housing 10 through a lever 50 that is pivoted by means of a pin 51. In a similar manner, parallel lever 52 on the hatch 47 is pivotally pinned to the lock frame through pivot pin 53.

The access hatch 47 and the port 43 permit the lock combination in the switch field 42 and the lock's power supply to be changed in accordance with the following procedure. With the door open, knob 11 is rotated in the positive direction until bolt 56 is fully extended. Control member 40 is now urging arm 64 against stop 66. Now, as the top of hatch 47 is urged rearward, a projection 57 which protrudes inwardly at a point that is just radially within the flange 23' also is urged against the outwardly directed peripheral flange 23' of disk 23, the knob 11 is slowly rotated in the negative direction until hatch 47 yields as projection 57 exits through port 43, and hatch 47 rotates to the fully open position. The knob may now be moved to, and held in, the optimum position for replacing the battery. Combination change is described later.

Although not shown in the drawing, the power supply for the lock, preferably in the form of a small dry cell battery, is mounted in an appropriate case, or the like, (also not shown) adjacent to the switch field 42 and between the switch field and the center of the disk 23. Upon completion of combination change and/or battery replacement the knob is rotated so as to position port 43, which is now visible, to permit ingress of projection 57 when hatch 47 is reclosed. The necessity for the foregoing procedure serves to impede any casual or playful attempt at tampering while yet permitting access through hatch 47 even if battery failure prevents proper functioning. Normally when the door is open the bolt is fully withdrawn and the knob is returned, by resilient means, to normal in which condition hatch 47 is locked by projection 57 which in turn is held captive within the outward flange 23' of disk 23. Port 43 is located so as not to coincide with projection 57 at any limiting position of the knob.

The tip of the bolt 56 is provided with a bevel 61 which utilizes the high forward thrust that is provided to the bolt 56 through the last portion of the locking motion imparted to the bolt through eccentric drive 62. The eccentric drive imparts a varying mechanical advantage to the bolt 56. The high thrust imparted to the bolt by the last bit of travel is utilized by the bevel 61 to tighten the door outwardly against the jamb and thereby enhance mechanical security.

More particularly, the inwardmost portion of the bolt 56 terminates in a hoilow cylindrical bolt belt 63 that slidably surrounds the cylindrical drive member 62 that is ecccentrically affixed to collar 75 which is rotatable about the spindle 20.

Arm 64, drive member 62, collar 75 and handle 73 are integrally joined and arranged to slidably rotate about axial spindle 20 which is affixed via member 76 to the inner wall 74 of the lock. The arm 64 is almost equal in length to the distance between the center of the disk 23 and a small portion of the radially disposed slot 35 in the control member. In accordance with a salient feature of the invention, the relative length of the arm 64 and the slot 35 is such that the member 40 in the control member 30, when pivoted in toward the center of the disk 23, will engage the tip of the arm 64. With the opposite orientation, however, that is with the member 40 in the control member 30 pivoted radially away from the center of the disk 23, a sufficient clearance will exist between the member 40 and the extreme tip of the arm 64 to enable the arm and the member 40 to pass each other without locking into a physical engagement.

The arm 64 has a flange or rib 65 along the positive edge of the arm and generally perpendicular to the plane of the arm. As shown, arm 64 and rib 65 abut against a stop 66 which protrudes into the lock from the inner wall of the lock housing (not shown in FIG. 1). Arm 64 and rib 65 are formed of nonmagnetic material. However, inset 67, which is flush with both the inward and outward surfaces of arm 64, is magnetically permeable and is located in arm 64 in such manner that the outward surface of inset 67 is in juxtaposition with pole piece 27 of switch housing 26 when control member 40 is in engagement with both member 72 and member 70.

Under this condition rotation in the negative direction of disk 23 carries along arm 64 until rib 65 impinges on permanent magnet 77 which projects outwardly from inner wall 74 of the lock housing, at which point bolt 56 is fully withdrawn. The outward face of magnet 77 is then in juxtaposition with the inward face of inset 67 which conducts the flux from magnet 77 through the arm 64 in the outward direction to pole piece 27 thereby activating reed switch 182 within the switch housing 26. This three part alignment (see FIG.

4) occurs only when activation of reed switch 182 within switch housing 26 is required.

A tip 70 on the arm 64 supports, on opposite sides of the tip in the plane of the arm, two small magnets 71, 72. It is important to note in connection with the invention that the polarities of the two magnets 71, 72 are reversed relative to each other. Thus, as shown in FIG. 1 the "south" pole of the magnet 71 is radially outward of the associated "north" pole with respect to the center of the disk 23. In contrast, the magnetic orientation of the magnet 72 on the rib side of the arm 64 is disposed with the "north" pole radially outermost.

It is important to note the means by which the proper spatial relationship between the arcuate paths of the engaging members 40 and 70 is assured. Control member 40 is part of the rotatable assembly consisting of disk 23, all of the equipment mounted thereon, knob 11 and the connecting collar 92. Engaging tip 70 is part of the rotatable assembly consisting of arm 64 with the members attached thereto, eccentric 62, collar 75 and handle 73. The axes of the above rotatable assemblies are held in alignment by, and are concentric with, spindle 20. To prevent linkage by friction, spindle 20 is fixed angularly by integral connection through member 76 to inner wall 74 of the lock housing, thereby dictating the choice of handle 73 instead of a conventional inner knob. However, a handle has the advantage that the condition of the lock is conspicuously indicated.

It will be recalled that the engaging member 40 in the control member 30 is selectively magnetizable. Thus, depending on relative polarity of the electrical current that is applied to the electromagnetic coil 37, the magnetic polarity at the tip of the engaging member 40 can be "north" or "south". Through appropriate regulation of the magnetic polarity of the engaging member 40, as hereinafter described, the engaging member 40 is repelled from or attracted to the magnets 71, 72 on the tip of the arm 64. Consequently, as the disk 23 that supports the control member 40 moves the control member 40 close to either of the magnets 71, 72 on the tip of the arm 64, the control member 40 either is subject to magnetic repulsion and pivots away from the tip 70 of the arm 64 to shift past the arm, or is attracted to the magnet 71 or the magnet 72 and thereby engages the arm 64 to cause the arm to move with the control member 30 and the disk 23.

Electronic Logic

Figure 3:
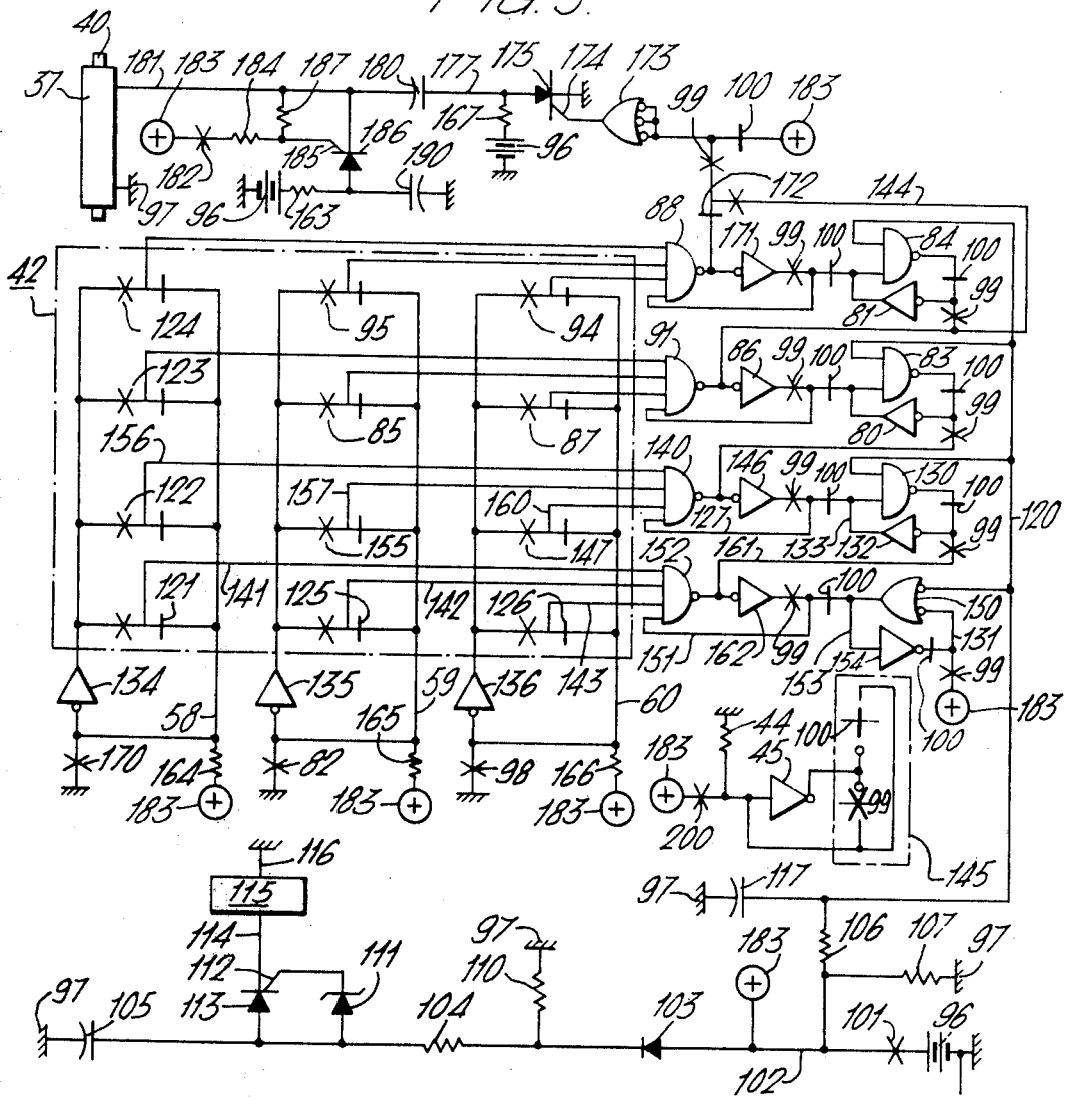
FIG. 3 is an electronic system using a mechanical switch memory.

FIG. 3 shows a typical electronic system for responding to a combination, applied to pushbuttons 12, 13, 14 of FIG. 2, which matches the combination stored in switch field 42 of FIG. 1, by appropriately polarized magnetization of the engaging member 40. When the lock system is normal, switch 101 is open thereby deenergizing all electronic components except capacitors 180, 190 which, however, draw no current when fully charged. The opening procedure begins with setting up and holding the initial digit on pushbuttons 12, 13, 14 of FIG. 2 which control switches 170, 82, 98 respectively. Recall, in this connection, the illustrative combination 0715. The initial digit 0, in this case, involves no pushbutton operation. The opening procedure is continued by rotating the knob 11 in the positive direction until stopped by engagement of member 40 with members 71, 70 in FIG. 1. At the start of knob rotation, the switch housing 24 separates from the bottom face of bolt 56 thereby activating switch 101 which connects battery 96 through conductor 102 to the positive feeder 183, diode 103 and resistors 106, 107. Feeder 183 energizes the entire system including the internal circuitry of logic gates, inverters and the transmission gates which are shown here as switches 99, 100. The current through diode 103 starts to charge capacitor 105 through resistor 104 to initiate the alarm timing. When feeder 183 energizes the system, the potential on conductor 120 remains in the "low" region for an interval determined by the charging rate of capacitor 117 through resistor 106 thereby inhibiting AND gates 84, 83, 130 while activating OR gate 150. The output of gate 150 through conductor 153 activates inverter 154 which, in turn, through transmission switch 100 and conductor 131 maintains gate 150 activated when the potential on conductor 120 goes high. In this manner the system is prepared to compare the initial input digit with the digit stored on memory switches 121, 125, 126. During the above-mentioned knob rotation, and just prior to engagement stop, switch housing 25 sweeps by projection 46 in FIG. 1, thereby momentarily activating switch 200, in turn momentarily activating all transmission switches 99 while momentarily deactivating all transmission switches 100. Each switch 99 or 100 is a solid state component which is activated by application of a high to one, and a low to the other, of its two control electrodes, in which state it is capable of transmitting either a high or a low signal in either direction. The switch is deactivated by reversing the control potentials. The manner in which switch 200, resistor 44 and inverter 45 control all of switches 99, 100 is shown by a sample pair of switches 145. As was stated above, gate 150 is activated, producing a high output which activates inverter 154 and, through associated switch 100 and conductor 151, enables an input of AND gate 152. To write in a digit having the value 0 switches 170, 82, 98 are open, each permitting a high from resistors 164, 165, 166 through the normally closed contacts of memory switches 121, 125, 126 and conductors 141, 142, 143 respectively to flow to the remaining inputs of AND gate 152 which is activated and, in turn, activates inverter 162. The aforementioned activation of switch 200 activates all switches 99 while deactivating all switches 100, as the result of which the output from inverter 162 replaces the output from gate 150 in maintaining activation of gate 152 through conductor 151. Simultaneously the output from gate 152, through conductor 161 and a switch 99 activates inverter 132 and, in turn, AND gate 130. Also simultaneously the output from inverter 154 is cut off by switch 100 from the input to gate 150 which is deactivated and, in turn, deactivates inverter 154. When switch 200 reopens, switches 99 are deactivated and switches 100 are reactivated causing the output from gate 130 to replace the output from gate 152 in maintaining activation of inverter 132. Simultaneously the high output from inverter 162 to conductor 151 and input of gate 152 is replaced by the low output from deactivated gate 150 thereby deactivating gate 152 and inverter 162.

If, however, any one or more of switches 170, 82, 98 is closed during the above activation of switches 99, the input to gate 152 associated with the closed switch receives a low signal which inhibits gate 152. Inasmuch as gate 150 and inverter 154 are deactivated as mentioned above, further inputs are ineffective. Assuming valid input of the initial digit as indicated by activation of inverter 132 and gate 130 the description of combination write-in continues. When knob rotation is stopped the combination on pushbuttons 12, 13, 14 is changed from digit value 0 to digit value 7. All three pushbuttons being depressed, switches 170, 82, 98 are all closed, inverters 134, 135, 136 are all activated, and with memory switches 122, 155, 147 all activated, the high outputs from inverters 134, 135, 136 are connected through conductors 156, 157, 160 to inputs of AND gate 140, the remaining input being enabled by output from inverter 132. Gate 140 and inverter 146 are activated. With the pushbuttons held depressed the knob is rotated through a small arc in the negative direction causing switch housing 25 to again sweep by projection 46 thereby again momentarily activating switch 200 and switches 99 while momentarily deactivating switches 100. In similar manner as described for the initial digit, inverter 80 and gate 83 are activated as gates 130, 140 and inverters 132, 146 are deactivated.

Figure 4:
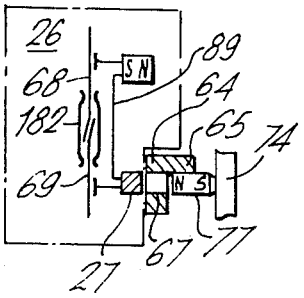
FIG. 4 shows the magnetic circuit for activating switch 182.

The third digit in the illustrative combination 0715 is addressed to the lock by depressing pushbutton 12 only which closes switch 170 whereas switches 82, 98 are open. Memory switch 123 being in the activated condition with switches 85, 87 deactivated gate 91 and inverter 86 are activated. With pushbutton 12 held in the depressed condition, the knob is rotated in the positive direction, and as switch housing 25 again sweeps by projection 46 switch 200 is again momentarily activated resulting in activation of inverter 81 and gate 84 whereas gates 83, 91 and inverters 80, 86 are deactivated. When knob rotation is stopped, the final digit is set up by depressing and holding pushbuttons 12, 14 which close switches 170, 98 thereby matching activated memory switches 124, 94 and activating gate 88 and inverter 171. The knob is then rotated through a small arc in the negative direction causing switch housing 25 to again sweep by projection 46, momentarily activating switch 200 and switches 99, thereby locking up gate 88 and inverter 171 as the output from gate 88 is also conducted through the normally closed contact of abbreviation switch 172, thence through a switch 99 to the paralleled inputs of OR gate 173. The amplified output of gate 173 triggers thyristor 175 thereby depressing the potential on conductor 177 to ground. This negative-going surge is propagated through fully charged capacitor 180, conductor 181 and coil 37 to ground 97 thereby generating a magnetic south pole on the tip of control member 40. Member 40, being of magnetically remanent material remains magnetized after the surge current is dissipated. Switch 200 remains closed for a very brief interval, at the conclusion of which switches 99 reopen thereby deactivating gates 88, 173, inverter 171 and the control electrode 174 of thyristor 175 which, however, is deactivated only when the surge current drops below the sustaining level. In this connection the resistance value of resistors 167, 163 limits the recharging current below the thyristor sustaining level. Knob rotation is then returned to the positive direction. Momentary functioning of switches, 200, 99, 100 has no effect. When control member 40 approaches tip 70 of arm 64, mutual repulsion between members 71, 40 causes member 40 to bypass tip 70 as rotation of disk 23 continues briefly until switch field 42 impinges on the top face 55 of bolt 56. Thereafter the knob is rotated in the negative direction and, as mutual attraction between members 40, 72 produces engagement between members 40, 70, arm 64 and eccentric 62 are rotated thereby retracting bolt 56. It is important to note that engagement of member 40 with members 72, 70 coincides with juxtaposition of pole piece 27 of reed switch housing 26 with the outward face of magnetically permeable inset 67 in arm 64. When the bolt 56 is fully retracted, arm 64 i stopped by the impinging of rib 65 against permament magnet 77 which projects outwardly from the inner wall 74 of the lock housing. At the same instant inset 67 conducts the magnetic flux from magnet 77 to pole piece 27 to activate switch 182 in FIGS. 3,4. Switch 182 connects positive feeder 183 through resistor 184 to control electrode 185 of thyristor 186 which discharges capacitor 190 in a positive-going surge through conductor 181 and coil 37 to ground 97, thereby generating a magnetic north pole on the tip of member 40. It should be noted that while switch 182 is open resistor 187 maintains control electrode 185 at the same potential as the negative electrode of thyristor 186. The north pole of member 40 is now repelled by the north pole of member 72 causing member 40 to bypass tip 70 as negative rotation continues until switch housing 24 impinges against the bottom face of bolt 56 thereby opening switch 101 and de-energizing the system except for the capacitors 180 and 190 which store a charge for use the next time the lock is to be opened from the outside. The door may be relocked from the inside by positive rotation of handle 73 or from the outside by positive rotation of knob 11 causing engagement of member 40 with members 71, 70. In either case arm 64 is rotated to re-extend bolt 56 to the locked condition shown in FIG. 1. Switch 172, which is mounted with, and accessed in the same manner as, the memory switches of switch field 42, provides the convenience of abbreviating the opening combination. As illustrated, activation of switch 172 eliminates only the last digit. It should be understood that, although only four digits and only three bits per digit are illustrated, the number of horizontal digit modules and/or the number of vertical bit modules may readily be varied. Abbreviation is more meaningful with an increase in the number of digit modules.

In accordance with a further feature of the invention, there is a novel aspect of the circuit that activates the alarm signal 115. If excessive time is consumed during the opening procedure, which might occur if the lock is subjected to tampering, the contacts 101 (FIG. 3) of the switch 24 (FIG. 1) are operated to complete the circuit that is shown in FIG. 3 from, the ground, through the battery 96, the closed contacts 101, the diode 103, the resistor 104 and the capacitor 105 to the ground. In this situation, the voltage on the capacitor 105 increases to a level that causes the zener diode 111 to "break down" and, because the diode 111 is connected to the control electrode 112 of the rectifier 113, to permit the rectifier 113 to conduct. In this condition, the charge on the capacitor 105 is discharged to the common ground by way of the rectifier 113, the conductor 114, the alarm signal 115 and the conductor 116. This discharge enables the alarm signal to sound. If, however, an attempt is made to overcome the alarm by returning the knob to normal before the voltage on the capacitor 105 reaches a level that will permit the zener diode 111 to discharge, an additional protection is provided in accordance with the invention.

If the contacts 101 remain closed, the capacitor 105 charges at a rate that is determined by the capacitance of the capacitor 105 and the resistance of the resistor 104. The discharge rate of the capacitor 105, however, when the knob is restored to normal and the contacts 101 are once more opened, is substantially slower, being determined by the capacitance of the capacitor 105 and the sum of the resistances 104 and 110. Consequently, the contacts 101 must remain open longer than they are closed, otherwise the charge on the capacitor 105 continues to accumulate with each successive attempt to open the lock until the alarm signal is sounded. The capacitance of the capacitor 105 is determined by the amount of stored energy required to activate the signal. The value of the resistance 104 is determined by the time required for a single successful application of the entire combination to the lock. The resistance value of the resistor 110 should be low enough to discharge the capacitor 105 between normal opening operations, but high enough to impose a considerable pause between tampering attempts.

Figure 5:
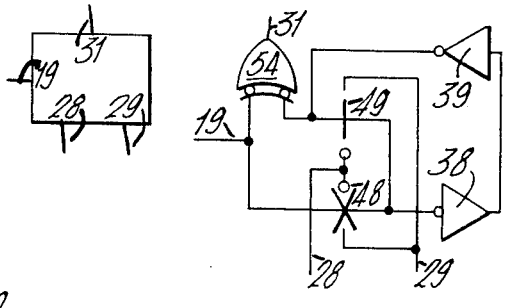
FIG. 5 shows the symbol and circuit of an electronic bit memory cell.
Figure 7:
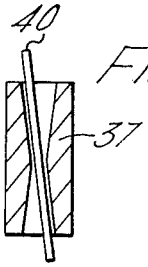
FIG. 7 shows an alternative control member.
Figure 6:
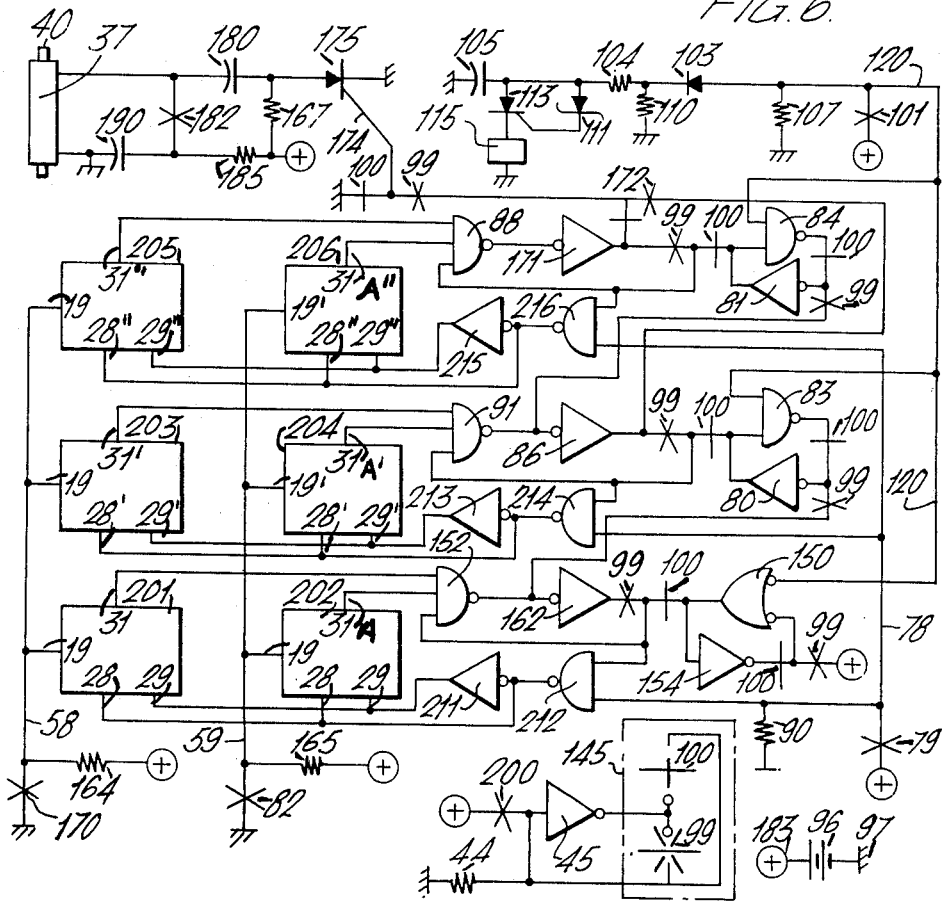
FIG. 6 shows an electronic system arranged for electronic memory.

The mechanical switch field 42, being a nonvolatile memory, is especially well suited for use in the lock of a vault or safe where drastic measures would be required if the stored combination were mutilated by accidental interruption of the energy supply. In the lock on a residential or commercial door, however, an electronic memory may be preferable because of the convenient manner in which the combination may be written in. FIG. 3 may be modified to incorporate an electronic memory as indicated by FIGS. 5, 6. FIG. 5 shows the symbol and circuit of an electronic bit memory cell. Twelve such cells replace the twelve switches of switch field 42. Write-in is enabled when the potentials on leads 28, 29 are low and high respectively thereby closing switch 48 while opening switch 49. Under this condition a low on lead 19 activates inverters 38, 39 whereas a high on lead 19 deactivates inverters 38, 39. In either case the inputs to exclusive--or gate 54 match each other thereby giving a high output to conductor 31. After completion of write-in the potentials on conductors 28, 29 return to high and low respectively, thereby reopening switch 48 and reclosing switch 49. Inverters 38, 39 are now locked in the activated state to store a 1, or in the deactivated state to store a O. When the signal state on lead 19 matches the output of inverter 39 the output of gate 54 is a high, otherwise the output is a low. FIG. 6 shows an electronic logic system using electronic bit memories of the type shown in FIG. 5. To illustrate the flexibility of the modular design FIG. 6 shows only two vertical or bit modules and only three horizontal or digit modules. The modular principle would also facilitate expansion, for example, to four bits and/or five digits. As indicated the positive feeder 183 is connected directly to the battery 96 so as to continuously energize bit memories 201–206 as well as all gates, inverters, and transmission switches. When knob 11 is back to normal and switch 101 is open the system is preset with gates 83, 84 deactivated and gate 150, inverter 154 both activated in preparation to process the initial digit. The opening procedure and processing of successive digits is the same as described for FIG. 3. For example, if bit memory 201 stores a one and bit memory 202 stores a zero, switch 170 must be closed and switch 82 must be open in order to activate gate 152 for the initial digit. If all three input digits match the stored digits, gate 88 and inverter 171 are activated, and with switches 99 closed the output of inverter 171 activates thyristor 175 which as described for FIG. 3 prepares control member 40 to bypass tip 70 of arm 64. Thereafter negative knob rotation carries along arm 64 thereby retracting bolt 56. When bolt 56 is fully retracted the three-part alinement shown in FIG. 4 obtains causing closure of switch 182 which in FIG. 6 discharges capacitor 190 through coil 37 thereby restoring control member 40 to its original magnetization. It should be noted that activation of thyristor 175 and the direct capacitor 190 discharge by switch 182 differ from the arrangement shown in FIG. 3 and may be possible by efficient design of coil 37 and core 40 whereby the power requirements of the surges through coil 37 are minimized. A further possibility is an alternative to the one-piece design of coil 37 and core 40, with coil 37 affixed to channel frame 32 and having a cavity so shaped as to permit core 40 to pivot about axis 41, as shown in cross section in FIG. 7, thereby minimizing the movable mass of the control member. A further modification is the addition of inverters and gates 211–216, switch 79, and resistor 90 for the purpose of writing in a new combination. Switch 79 is accessed through frontal closure 47 in the same manner as described for access to abbreviation switch 172. Closure of switch 79 enables an input each of gates 212, 214, 216. The knob is then returned briefly to normal thereby preparing the system in the same manner as for regular digit processing. The output of gate 150 activates gate 212 and inverter 211 thereby applying a low and high signal to inputs 28, 29 respectively of bit memories 201, 202. The new combination for the initial digit is then written into the memories by manipulation of switches 170, 82. Match being inevitable, the outputs on leads 31 are high, activating gate 152. Thereafter digit processing continues as previously described.

The embodiments of the invention in which an exclusive property or privilege is claimed are defined as follows:

1. A combination lock comprising a housing, a bolt selectively retractable within said housing, a rotatable arm for retracting said bolt, a rotatable knob journalled in said housing, a remanent control member within said housing for selectively engaging said arm, said control member being rotatable with said knob, a coil surrounding said remanent control member, a circuit means to selectively energize said coil so as to selectively magnetize said remanent control member, a set of two-state memory elements for storing any one of all combinations of said memory elements, and said circuit means being responsive to signals that correspond to said stored combination for engaging and disengaging said remanent control member and said rotatable arm for selective movement with said remanent control member in order to retract said bolt.

2. A combination lock according to claim 1 wherein said arm further comprises two magnets thereon, and said control member has a remanently magnetizable engaging member for attraction to and repulsion from said arm magnets in order to engage and disengage said arm for selective movement with said engaging member to retract said bolt.

3. A combination lock according to claim 1 comprising further an abbreviating switch for selectively enabling said control member and said rotatable arm for engaging and disengaging in response to signals that correspond to a predetermined part of said stored combination.

4. A combination lock according to claim 1 wherein said circuit means further comprises a plurality of tactile switches for producing successive signals that correspond to successive digits of said stored combination to enable said control member to engage and disengage said rotatable arm for selective movement with said control member.

5. A combination lock according to claim 1 wherein said bolt comprises an essentially straight member having two opposite ends, one of said ends for selectively protruding from said lock housing and the other of said bolt ends being eccentrically linked to said rotatable knob in response to said lock combination signals in order to increase the mechanical advantage as said one end protrudes from said lock housing.

6. A combination lock according to claim 1 wherein said circuit means comprises a circuit for electrically energizing said coil to establish a selective first and second magnetic polarity comprising means for establishing an electrical path from ground through said coil that includes a first capacitor connected to said coil, a first thyristor connected to said first capacitor and to ground, said first thyristor having a control electrode for receiving signals to establish said first magnetic polarity, a second thyristor connected between said coil and said first capacitor, said second thyristor being coupled to ground through a second capacitor, said second thyristor control electrode being connected through a resistor to switch means for applying a signal to establish said second magnetic polarity and through a resistor to said second thyristor connection with said coil.

7. A combination lock according to claim 3 wherein each element of said set of memory elements comprises a manually resettable switch for enabling said stored combination to be changed.

8. A combination lock according to claim 7 wherein each element of said set of memory elements comprises an electronically changeable memory, and further comprises a combination change switch and circuitry to enable change of said stored combination by manipulation of said tactile switches.

9. A combination lock according to claim 8 further comprising electrical energy supply means and a frontal aperture for access to said energy supply means, said abbreviating switch, said manually resettable switches, or said combination change switch.

10. A combination lock according to claim 14 further comprising closure means being interlocked with action of said knob for the purpose of impeding unauthorized access through said frontal aperture.

11. A combination lock according to claim 4 wherein said circuit means further comprises processing circuitry for generating signals that enable said control member to engage and disengage said rotatable arm, switch means responsive to successive alternating partial rotations of said knob for enabling said processing circuitry and said tactile switches for applying said successive signals that correspond to successive digits of said stored combination to said respective processing circuitry to enable said processing circuitry to generate said control member enabling signals.

12. A combination lock according to claim 4 further comprising modular circuits each individual to a respective combination digit for producing signals in response to separate manipulation sequences of said plurality of tactile switches.

13. A combination lock according to claim 4 further comprising modular circuits each individual to a respective combination bit for producing signals in response to separate manipulation sequences of said plurality of switches.

14. A multiple digit combination lock comprising a housing, a bolt selectively retractable within said housing, a rotatable arm for retracting said bolt, two magnets on said arm, a rotatable knob journalled in said housing, a control member within said housing for selectively engaging said arm, said control member being rotatable with said knob, a magnetizable engaging member in said control member for attraction to and repulsion from said arm magnets in order to engage said arm for selective movement with said engaging member to retract said bolt, circuit means responsive to the stored combination for generating signals to magnetize said engaging member to said arm magnet attraction and repulsion, processing circuitry in said circuit means for generating signals that enable said control member to engage and disengaged said rotatable arm, further switch means activated in response to said knob rotation for enabling said processing circuitry, and tactile switches in said circuit means for producing successive signals that correspond to successive digits of said stored combination to apply said produced signals to said individual processing circuitry to enable said processing circuitry to generate said control member signals for magnetizing said engaging member.

* * * * *